US005179068A

United States Patent [19]

Goto

[11] Patent Number: 5,179,068

[45] Date of Patent: Jan. 12, 1993

[54] HEAT-SENSITIVE RECORDING MATERIAL

[75] Inventor: Atsuo Goto, Tokyo, Japan

[73] Assignee: Mitsubishi Paper Mills Limited, Tokyo, Japan

[21] Appl. No.: 787,949

[22] Filed: Nov. 5, 1991

[30] Foreign Application Priority Data

Nov. 6, 1990 [JP] Japan ..... 2-300428

[51] Int. Cl.[5] ..... B41M 5/30

[52] U.S. Cl. ..... 503/209; 503/208

[58] Field of Search ..... 503/208, 209, 215

[56] References Cited

U.S. PATENT DOCUMENTS

| | | | |
|---|---|---|---|
| 4,471,074 | 11/1984 | Iwakura et al. | 503/209 |
| 4,599,271 | 7/1986 | Chao | 503/215 |

FOREIGN PATENT DOCUMENTS

| | | |
|---|---|---|
| 0414243 | 2/1991 | European Pat. Off. . |
| 3703479 | 8/1987 | Fed. Rep. of Germany . |
| 62-292479 | 12/1987 | Japan . |
| 1-132555 | 5/1989 | Japan . |
| 1-208183 | 8/1989 | Japan . |
| 2-006280 | 1/1990 | Japan . |
| 2-153785 | 6/1990 | Japan . |
| 2165953 | 4/1986 | United Kingdom . |

*Primary Examiner*—Pamela R. Schwartz
*Attorney, Agent, or Firm*—Cushman, Darby & Cushman

[57] ABSTRACT

Disclosed is a heat-sensitive recording material comprising a support and a heat-sensitive recording layer provided on the support, the heat-sensitive recording layer comprises a dye precursor, a developer, a binder and an aromatic compound represented by the following structural formula:

(I)

wherein $R^1$, $R^2$ and $R^3$ are independently hydrogen atoms or lower alkyl groups; $R^4$, $R^5$ and $R^6$ are independently hydrogen atoms, alkyl groups, cycloalkyl groups, alkoxy groups, halogen atoms, aralkyl groups, aryl groups, acyl groups, formyl groups, nitro groups or cyano groups; and $X^1$ and $X^2$ are oxygen atoms or sulfur atoms. This heat-sensitive recording material is excellent in heat responsiveness and sensitivity, and cause little thermal head stain.

3 Claims, No Drawings

HEAT-SENSITIVE RECORDING MATERIAL

This invention relates to a heat-sensitive recording material excellent in heat responsiveness and matching properties with printing machines. More particularly, this invention relates to a heat-sensitive recording material which causes little stain adhering to a thermal head (such stain is hereinafter referred to as "thermal head stain") when printing is effected.

Generally, heat-sensitive recording materials comprise a support having provided thereon a heat-sensitive recording layer comprising, as essential components, an electron-donating dye precursor which is generally colorless or pale-colored and an electron-accepting developer. Upon heating the heat-sensitive recording material by a thermal head, a thermal pen, a laser beam, or the like, the dye precursor and the developer instantlly react with each other to give recorded images. Such heat-sensitive recording materials are disclosed in Japanese Pat. Appln. Kokoku Nos. S.43-4160 and S.45-14039 and the like.

When such heat-sensitive recording materials are used, records can be obtained by a relatively simple apparatus, the maintenance of the apparatus is easy, and it is quiet. Thus, the heat-sensitive recording materials are used in a wide variety of fields such as measuring recorders, facsimiles, printers, terminals of computers, labels, ticket vending machines, and the like. Particularly, the demand for heat-sensitive recording materials has greatly increased in the field of facsimiles. In this field, attempts have been made for the purpose of speed-up of recording in order to reduce transmission cost, miniaturization of facsimile machines, and reducing the price thereof. As a result, applied energy for forming images has been greatly reduced recently. Therefore, it has been strongly desired to develop a heat-sensitive recording material having high sensitivity and sufficient heat responsiveness in order to meet these requirements (i.e. miniaturization of facsimile machines, reduction of applied energy for forming images, etc.). In a high speed recording, it is required that a small amount of thermal energy emitted from a thermal head for quite short period (generally 1 msec or less) be effectively used for the coloring reaction to form colored images having high density.

In order to attain the above object, it has been suggested that a heat-meltable substance having relatively low melting point is used as a sensitizer along with a dye precursor and an electron-accepting compound which reacts with the dye precursor to form color. As the sensitizer, there are disclosed, for example, naphthol derivatives in Japanese Pat. Appln. Kokai Nos. S.57-64593 and S.58-87094; naphthoic acid derivatives in Japanese Pat. Appln. Kokai Nos. S.57-64592, S.57-185187, S.57-191089, S.58-110289, and S.59-15393; ether or ester derivatives of phenol compounds in Japanese Pat. Appln. Kokai Nos. S.58-72499, S.58-87088 and S.58-87094, and G.B. Patent Publication No. 2,165,953.

In principle, when printing is effected on a heat sensitive recording material, the dye precursor, the developer and the sensitizer are molten with heat transferred from a thermal head to form color. Therefore, the molten mixture tends to adhere to a thermal head of a facsimile, etc. to cause thermal head stain. Particularly when printing is effected for a long time, such thermal head stain deteriorates qualities of printed images. Thus, conventional heat-sensitive recording materials have poor matching properties with printing machines such as a facsimile.

In order to reduce thermal head stain, fillers such as talk, clay and starch are contained in a heat-sensitive recording layer. However, sufficient effects cannot be obtained by means of such a method.

Accordingly, there has been desired development of a heat-sensitive recording material which cause little thermal head stain in order to obtain printed images of high qualities even when printing is effected for a long time.

Particularly, sensitizers (agents to accelerate coloring) are generally low melting-point substances, and hence are often main cause of thermal head stain. Therefore, development of a sensitizer free from such disadvantage has been strongly desired.

As described above, such a heat-sensitive recording material cannot be obtained that has excellent heat responsiveness, gives images of high color density and has sufficient matching properties with machines (especially causes little thermal head stain).

It is an object of this invention to obtain a heat-sensitive recording material which is excellent in heat-responsiveness, recording sensitivity and cause little thermal head scum.

According to this invention, there is provided a heat-sensitive recording material comprising a support and a heat-sensitive recording layer provided on the support, the heat-sensitive recording layer comprises a dye precursor, a developer, a binder, and an aromatic compound represented by the following structural formula:

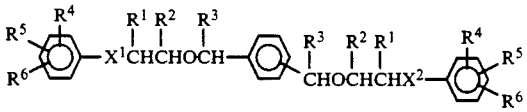

(I)

wherein $R^1$, $R^2$ and $R^3$ are independently hydrogen atoms or lower alkyl groups, $R^4$, $R^5$ and $R^6$ are independently hydrogen atoms, alkyl groups, cycloalkyl groups, alkoxy groups, halogen atoms, aralkyl groups, aryl groups, acyl groups, formyl groups, nitro groups or cyano groups, and may be linked with each other to form a cyclic stracture; and $X^1$ and $X^2$ are oxygen atoms or sulfur atoms and may be identical with or different from each other.

Preferably, the aromatic compound is represented by the following structural formula:

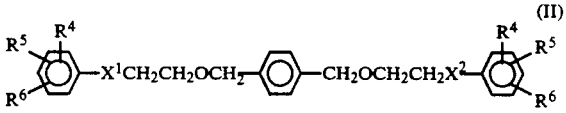

(II)

wherein $X^1$, $X^2$, $R^4$, $R^5$ and $R^6$ are respectively the same as defined in the formula (I).

More preferably, the aromatic compound is represented by the following structural formula:

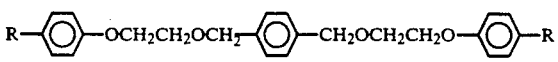

(III)

wherein R is hydrogen atom, halogen atom or lower alkyl group.

This invention is explained in detail below.

The heat-sensitive recording material of this invention comprises a support and a heat-sensitive recording layer provided on the support.

The heat-sensitive recording layer contains a dye precursor, a developer, a binder, and a specific aromatic compound as essential components.

As the aromatic compound used in this invention, the following compounds may be mentioned. These examples are to be considered as illustrative and not restrictive.

(1)

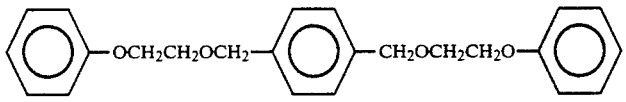

(2)

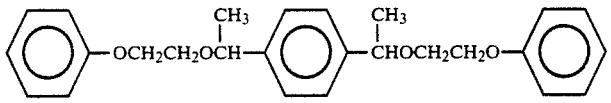

(3)

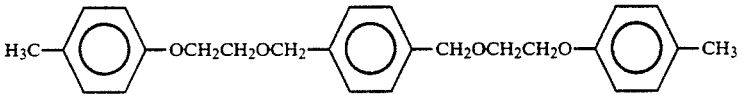

(4)

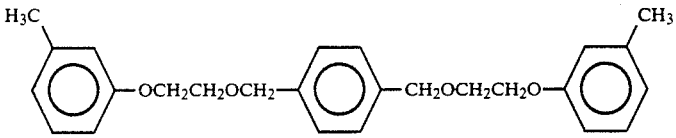

(5)

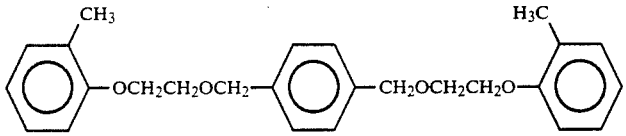

(6)

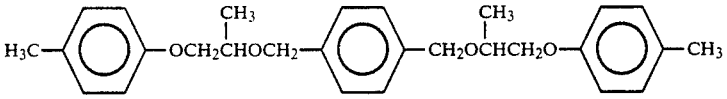

(7)

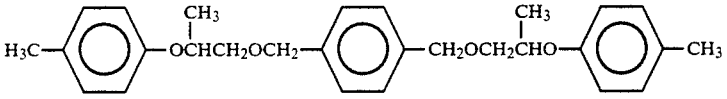

(8)

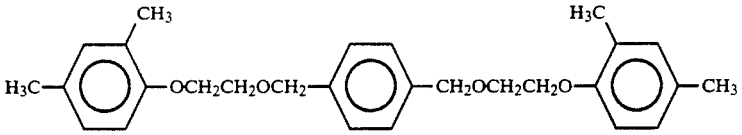

(9)

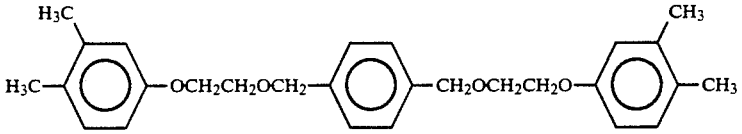

(10)

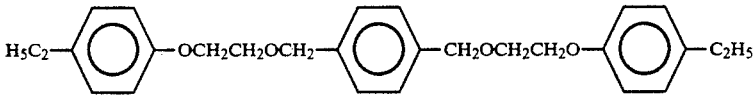

(11)

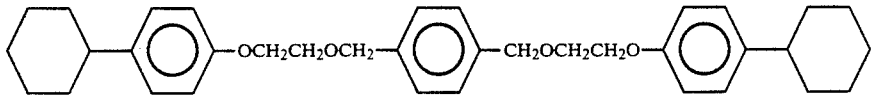

-continued
(12)
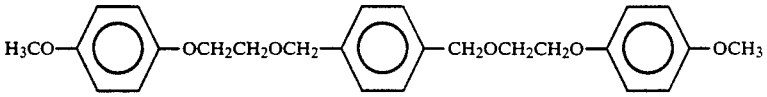
(13)
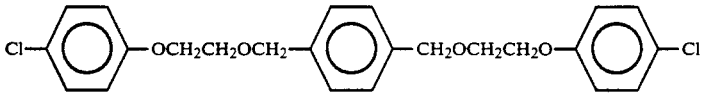
(14)
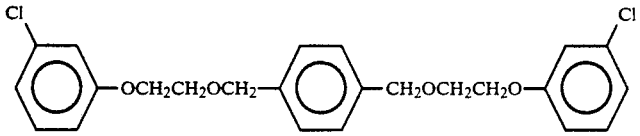
(15)
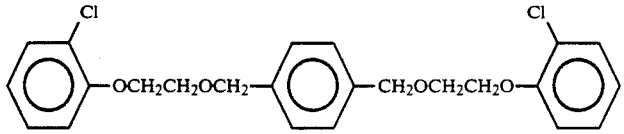
(16)
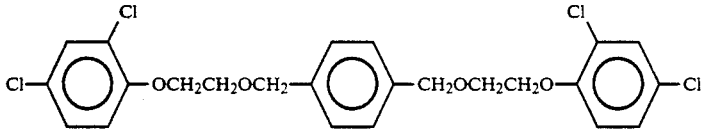
(17)
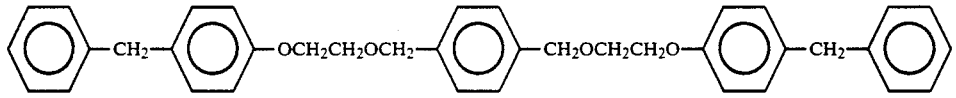
(18)
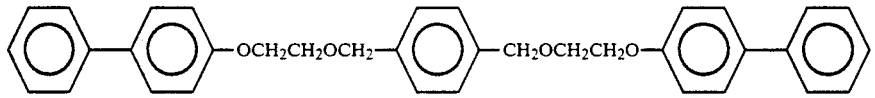
(19)
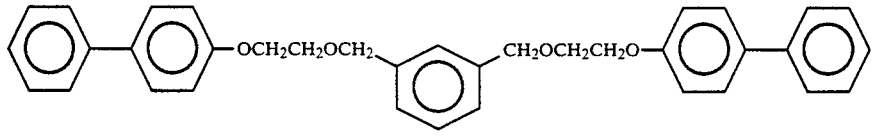
(20)
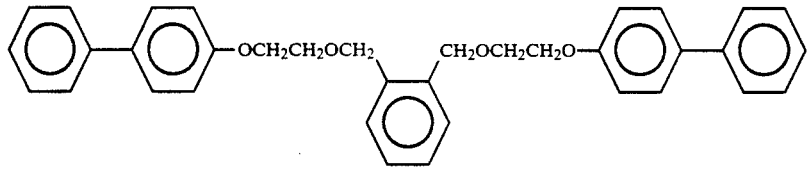
(21)
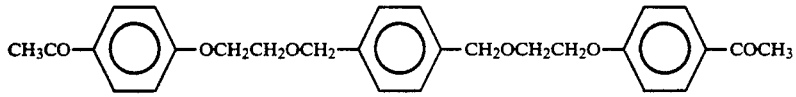
(22)
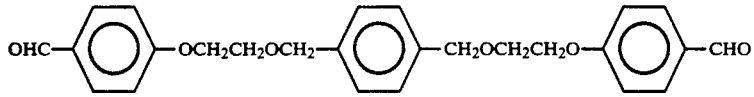
(23)
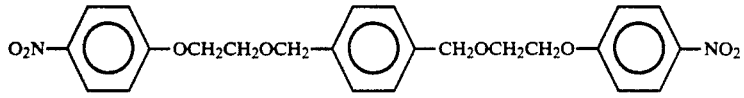

-continued

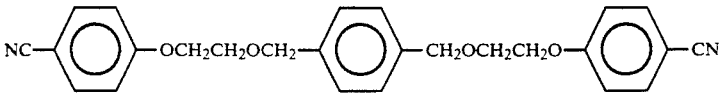

(24)

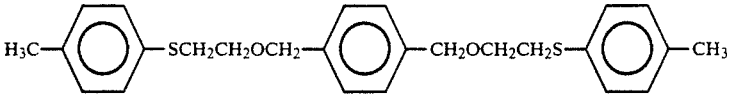

(25)

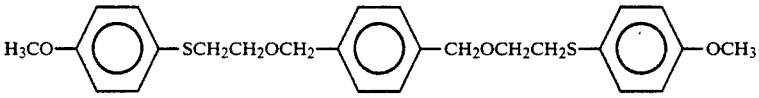

(26)

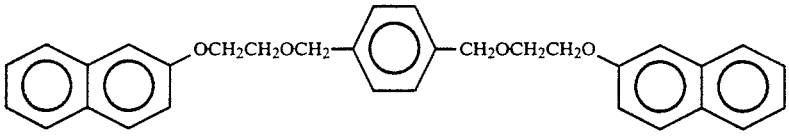

(27)

Synthesis Examples of some of the aromatic compounds used in this invention are specifically described below. These Examples are to be considered as illustrative and not restrictive.

SYNTHESIS EXAMPLE 1

Synthesis of 1,4-bis(2-phenoxyethoxymethyl)benzene (Compound 1)

Into a 200 ml three necked flask equipped with a stirrer, condenser and thermometer were charged 13.8 g of 2-phenoxyethanol, 8.8 g of p-xylylene dichloride, 2.0 g of trioctylmethylammonium chloride, 40 g of 40% aqueous solution of sodium hydroxide and 100 ml of toluene.

The resulting mixture was insensely stirred in a stream of nitrogen at 70°-80° C. for 2 hours.

After cooling to room temperature, the mixture was washed with water until the resulting organic layer became neutral. After drying over anhydrous sodium sulfate, toluene was evaporated in vacuo. The residue was recrystallized from 200 ml of methanol to obtain 11.0 g of the objective compound having a melting point of 50°-50.5° C.

SYNTHESIS EXAMPLE 2

Synthesis of
1,4-bis[2-(4-methylphenoxy)ethoxymethyl]benzene (Compound 3)

Into a 300 ml three necked flask equipped with a stirrer, condenser and thermometer were charged 11.9 g of p-cresol, 10.7 g of ethylenecarbonate, 0.8 g of potassium carbonate, and 100 ml of chlorobenzene. The resulting mixture was refluxed in a stream of nitrogen for 3 hours. After cooling to room temperature, 50 ml of chlorobenzene, 7.9 g of p-xylylene dichloride, 2.0 g of trioctylmethylammonium chloride and 35 g of 40% aqueous solution of sodium hydroxide. This mixture was intensely stirred in a stream of nitrogen at 70°-80° C. for 2 hours. Cooling to room temperature, the mixture was washed with water until the resulting organic layer became neutral. After drying over anhydrous sodium sulfate, chlorobenzene was evaporated in vacuo. The residue was recrystallized from 300 ml of ethanol to obtain 10.7 g of the objective compound having a melting point of 86.5°-87° C.

SYNTHESIS EXAMPLE 3

Synthesis of
1,4-bis[2-(4-chlorophenoxy)ethoxymethyl]benzene (Compound 13)

Synthesis was carried out in the same manner as in Synthesis Example 1 to obtain the objective compound having a melting point of 94.5°-95° C.

The process for producing the heat-sensitive recording material of this invention is specifically explained below.

The heat-sensitive recording material of this invention comprises a support having provided thereon a heat-sensitive recording layer comprising, as essential components, an electron-donating dye precursor which is generally colorless or pale-colored and an electron-accepting developer. Upon heating the heat-sensitive recording material by a thermal head, a thermal pen, a laser beam, or the like, the dye precursor and the developer instantlly react with each other to give recorded images. Such heat-sensitive recording materials are disclosed in Japanese Pat. Appln. Kokoku Nos. S.43-4160 and S.45-14039 and the like. If necessary, the heat-sensitive recording layer may contain a pigment, sensitizer, antioxidant, antisticking agent, and the like.

In this invention, any dye precursor which is generally used for pressure-sensitive recording papers or heat-sensitive recording papers. Specifically, the following compounds may be mentioned:

(i) Triarylmethane Type Compounds 3,3-bis(p-dimethylaminophenyl)-6-dimethylaminophthalide (Crystal Violet Lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, etc.

(ii) Diphenylmethane Type Compounds 4,4'-bis(dimethylaminophenyl)benzhydryl benzyl ether, N-chlorophenylleucoauramine, N-2,4,5-trichlorophenylleucoauramine, etc.

(iii) Xanthene Type Compounds

Rhodamine B anilinolactam, Rhodamine B p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)-fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl)amino-6-methyl-7-anilinofluoran, etc.

(iv) Thiazine Type Compounds

Benzoyl Leucomethylene Blue, p-nitrobenzoyl Leucomethylene Blue, etc.

(v) Spiro Type Compounds 3-methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, etc.

These compounds may be used alone or in combination of two or more.

In this invention, any developer which is an acidic, electron-accepting compound and generally used for heat-sensitive recording papers can be used. For example, phenol derivatives, aromatic carboxylic acid derivatives, N,N'-diarylthiourea derivatives, polyvalent metal salts (e.g. zinc salt) of organic compounds, and the like can be used. Among these compounds, phenol derivatives are especially preferable. Specifically, there may be mentioned p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)-hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-bis[2-(p-hydroxyphenyl)-2-propyl]-benzene, 1,3-bis[2-(3,4-dihydroxyphenyl)-2-propyl]benzene, 1,4-bis[2-(p-hydroxyphenyl)-2-propyl]benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-tert-butyl-5-methylphenol), benzyl p-hydroxybenzoate, chlorobenzyl p-hydroxybenzoate, dimethyl 4-hydroxyphthalate, benzyl gallate, stearyl gallate, salicylanilide, 5-chlorosalicylanilide, and the like.

The binder used in this invention includes water-soluble binders such as starches, hydroxyethylcellulose, methylcellulose, carboxymethylcellulose, gelatin, casein, polyvinylalcohol, modified polyvinyl alcohol, sodium polyacrylate, acrylamide/acrylic acid ester copolymer, acrylamide/acrylic acid ester/methacrylic acid terpolymer, alkali salts of styrene/maleic anhydride copolymer, alkali salts of ethylene/maleic anhydride copolymer, etc; latexes such as polyvinyl acetate, polyurethane, polyacrylic acid ester, styrene/butadiene copolymer, acrylonitrile/butadiene copolymer, methyl acrylate/butadiene copolymer, ethylene/vinyl acetate copolymer, etc; and the like.

In addition to the above components, the heat-sensitive layer may contain the following compounds in order to further improve sensitivity: a wax such as N-hydroxymethylstearamide, stearamide or palmitamide; a naphthol derivative such as 2-benzyloxynaphthalene; a biphenyl derivative such as p-benzylbiphenyl or 4-allyloxybiphenyl; a polyether compound such as 1,2-bis(3-methylphenoxy)ethane, 2,2'-bis(4-methoxyphenoxy)diethyl ether or bis(4-methoxyphenyl) ether; a derivative of carbonic acid ester or oxalic acid ester such as diphenyl carbonate, dibenzyl oxalate or bis(p-methylbenzyl) oxalate; and the like.

As the pigments, there may be mentioned diatomaceous earth, talc, kaolin, calcined kaolin, calcium carbonate, magnesium carbonate, titanium oxide, zinc oxide, silicon oxide, aluminum hydroxide, urea-formaldehyde resin, and the like.

For the purpose of the prevention of head abrasion, sticking, and the like, if necessary, the heat-sensitive recording layer may further contain polyvalent metal salts of higher fatty acids such as zinc stearate or calcium stearate; a wax such as paraffin, oxidized paraffin, polyethylene, oxidized polyethylene, stearamide or castor wax; a dispersant such as sodium dioctylsulfosuccinate; ultraviolet-ray absorbents of benzophenone type, benzotriazole type or the like; a surfactant; a fluorescent dye; and the like.

As the support used in this invention, mainly used is a paper; however, a nonwoven fabric, a plastic film, a synthetic paper, a metal foil, a composite sheet consisting of a combination of them, or the like can also be used.

Moreover, various arts well-known in the field of heat-sensitive recording materials can be utilized. For example, an overcoating layer can be provided on the heat-sensitive recording layer in order to protect the heat-sensitive recording layer, and an undercoating layer can be provided between the heat-sensitive recording layer and the support, which undercoating layer comprises a pigment and or a resin and has a single-layered or multi-layered structure.

The coating weight of the heat-sensitive recording layer is determined by the amount of the color-forming components, i.e. the dye precursor and developer. In general, the amount of the dye precursor is preferably 0.1–1.0 g/m$^2$. The amount of the developer is preferably 5–400% by weight, more preferably 20–300% by weight, based on the weight of the dye precursor.

The aromatic compound is contained in an amount of preferably 5–400% by weight, more preferably 20–300% by weight, based on the weight of the developer.

The following Examples further illustrate the invention.

Hereinafter, "part(s)" and "%" represent "(part(s) by weight" and "% by weight" respectively.

(I) Preparation of a Heat-Sensitive Recording Material

EXAMPLE 1

(1) Preparation of a Coating Composition for a Heat-Sensitive Recording Layer

To 80 parts of a 2.5% aqueous solution of polyvinyl alcohol was added 35 parts of 3-dibutylamino-6-methyl-7-anilinofluoran as a dye precursor. The resulting mixture was ground in a ball mill for 24 hours to obtain a dye dispersion.

On the other hand, to 60 parts of a 2.5% aqueous solution of polyvinyl alcohol was added 40 parts of 2,2-bis(p-hydroxyphenyl)propane as a developer. The resulting mixture was ground in a ball mill for 24 hours to obtain a developer dispersion.

To 120 parts of a 2.5% aqueous solution of polyvinyl alcohol was added 50 parts of 1,4-bis(2-phenoxyethoxymethyl)benzene (compound 1). The resulting mixture was ground in a ball mill for 24 hours to obtain an aromatic compound dispersion.

The three dispersions obtained above were mixed with one another. To the resulting dispersion mixture was added the following composition with stirring and mixed enough to obtain a coating composition for a heat-sensitive recording layer.

| | |
|---|---|
| 50% dispersion of calcium carbonate: | 100 parts |
| 40% dispersion of zinc stearate: | 25 parts |
| 10% aqueous solution of polyvinyl alcohol: | 185 parts |
| Water: | 280 parts |

(2) Preparation of a Paper for a Heat-Sensitive Recording Material

A coating composition containing the following components was coated on a base paper having a basis weight of 40 g/m$^2$ so as to obtain a coating weight of 9 g/m$^2$ in terms of solid content. Thus coated paper was dried to obtain a paper for a heat-sensitive recording paper.

| | |
|---|---|
| Calcined kaolin: | 100 parts |
| 50% dispersion of styrene-butadiene type latex: | 24 parts |
| Water: | 200 parts |

(3) Preparation of a Heat-Sensitive Recording Material

The coating composition for a heat-sensitive recording layer obtain in (1) above was coated on the paper for a heat-sensitive recording material obtained in (2) above so as to obtain a coating weight of 4 g/m$^2$ in terms of solid content. Thus coated paper was dried to obtain a heat-sensitive recording material.

EXAMPLES 2 AND 3

The same procedure as in Example 1 was repeated, except that 1,4-bis[2-(4-methylphenoxy)ethoxymethyl]benzene (Compound 3) and 1,4-bis[2-(4-chlorophenoxy)ethoxymethyl]benzene (Compound 13) were used in Examples 2 and 3, respectively, instead of 1,4-bis(2-phenoxyethoxymethyl)benzene used in Example 1.

COMPARATIVE EXAMPLE 1

The same procedure as in Example 1 was repeated, except that 1,4-bis(2-phenoxyethoxymethyl)benzene (compound 1) used in Example 1 was eliminated to obtain a heat-sensitive recording material.

COMPARATIVE EXAMPLES 2–5

The same procedure as in Example 1 was repeated, except that the following compounds were used instead of 1,4-bis(2-phenoxyethoxymethyl)benzene (compound 1) used in Example 1 to obtain a heat-sensitive recording material.

| Comparative | |
|---|---|
| Example 2: | N-hydroxymethylstearamide |
| Example 3: | β-benzyloxynaphthalene |
| Example 4: | α,α'-diphenoxy-o-xylene |
| Example 5: | 1,3-bis(2-phenoxyethoxy)benzene |

(II) Evaluation of a Heat-Sensitive Recording Material

The heat-sensitive recording materials obtained in (I) above were subjected to calendering treatment so that the side where the heat-sensitive recording layer was provided had a Bekk smoothness of 400–500 sec.

(1) Sensitivity

On the heat-sensitive recording materials, printing was carried out by a facsimile tester (manufactured by Okura Denki K.K., TH-PMD) at a heat voltage of 12 V and a pulse width of 0.5 or 0.7 ms using a thermal head having a dot density of 8 dots/mm and a head resistance of 185Ω.

Optical densities of thus printed portion and unprinted portion (i.e. while ground) were measured by a Macbeth RD-918 type reflection densitometer.

(2) Thermal Head Stain

Using a facsimile (manufactured by Canon Inc., Canofax 280) and CCITT chart No. 8, printing was continuously effected extending over 30 m in length. Thereafter, the thermal head was observed by the eye to check up the presence of thermal head stain.

The results obtained (1) and (2) above are shown in the following table. "o" represents that thermal head stain was not substantially observed so that the heat-sensitive recording material was good for practical use. "Δ" represents that thermal head stain was considerably observed so that the heat-sensitive recording material might cause some problem for practical use. "x" represents that thermal head stain was remarkably observed so that the heat-sensitive recording material was not able to be used in practice.

TABLE

| | Optical density | | | Thermal head stain |
|---|---|---|---|---|
| | Unprinted portion | Printed portion 0.5 ms | Printed portion 0.7 ms | |
| Example 1 | 0.05 | 0.88 | 1.32 | o |
| Example 2 | 0.05 | 0.96 | 1.33 | o |
| Example 3 | 0.05 | 0.89 | 1.33 | o |
| Comparative Example 1 | 0.05 | 0.47 | 0.88 | — |
| Comparative Example 2 | 0.06 | 0.65 | 1.18 | x |

TABLE-continued

| | Optical density | | | Thermal |
|---|---|---|---|---|
| | Unprinted | Printed portion | | head |
| | portion | 0.5 ms | 0.7 ms | stain |
| Comparative Example 3 | 0.06 | 0.86 | 1.33 | x |
| Comparative Example 4 | 0.06 | 0.96 | 1.37 | Δ |
| Comparative Example 5 | 0.06 | 0.89 | 1.36 | x |

As is clear from the above results, the heat-sensitive recording materials of the present invention are excellent in heat responsiveness and sensitivity so that images having higher color density can be obtained compared with those obtained in the prior art. Furthermore, the present heat-sensitive recording materials do not substantially cause thermal head stain.

Such advantageous effects come from the use of the aromatic compound specified above in the heat-sensitive recording layer.

What is claimed is:

1. A heat-sensitive recording material which comprises a support and a heat-sensitive recording layer provided on the support, the heat-sensitive recording layer comprising a dye precursor, a developer, a binder, and an aromatic compound represented by the following structural formula:

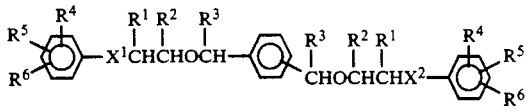

(I)

wherein $R^1$, $R^2$ and $R^3$ are independently hydrogen atoms or lower alkyl groups; $R^4$, $R^5$ and $R^6$ are independently hydrogen atoms, alkyl groups, cycloalkyl groups, alkoxy groups, halogen atoms, aralkyl groups, aryl groups, acyl groups, formyl groups, nitro groups or cyano groups, and may be linked with each other to form a cyclic structure; and $X^1$ and $X^2$ are oxygen atoms or sulfur atoms and may be identical with or different from each other.

2. A heat-sensitive recording material according to claim 1, wherein the aromatic compound is represented by the following structural formula:

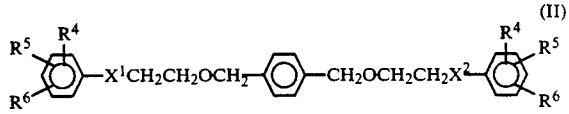

(II)

wherein $X^1$, $X^2$, $R^4$, $R^5$ and $R^6$ are respectively the same as defined in the formula (I).

3. A heat-sensitive recording material according to claim 1, wherein the aromatic compound is represented by the following structural formula:

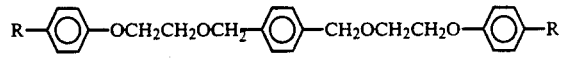

(III)

wherein R is hydrogen atom, halogen atom or lower alkyl group.

* * * * *